US010198973B2

(12) United States Patent
Johnston

(10) Patent No.: US 10,198,973 B2
(45) Date of Patent: Feb. 5, 2019

(54) NUMERICAL CONFIGURATION APPARATUS

(71) Applicant: Gary Lawrence Johnston, Cowarts, AL (US)

(72) Inventor: Gary Lawrence Johnston, Cowarts, AL (US)

( * ) Notice: Subject to any disclaimer, the term of this patent is extended or adjusted under 35 U.S.C. 154(b) by 0 days.

(21) Appl. No.: 15/643,508

(22) Filed: Jul. 7, 2017

(65) Prior Publication Data

US 2017/0372644 A1 Dec. 28, 2017

Related U.S. Application Data

(63) Continuation of application No. 14/810,397, filed on Jul. 27, 2015, now Pat. No. 9,704,420.

(51) Int. Cl.

| | |
|---|---|
| ***G09F 7/08*** | (2006.01) |
| ***G09F 7/22*** | (2006.01) |
| ***G09F 9/302*** | (2006.01) |

(52) U.S. Cl.

CPC ..... *G09F 7/08* (2013.01); *G09F 7/22* (2013.01); *G09F 9/3023* (2013.01)

(58) Field of Classification Search

CPC . G09F 9/302; G09F 9/37; G09F 9/375; G09F 7/12; B41J 2/34

See application file for complete search history.

(56) References Cited

FOREIGN PATENT DOCUMENTS

| | | | |
|---|---|---|---|
| FR | 2543337 A1 | * | 9/1984 |
| JP | 2013017671 A | * | 1/2013 |
| ZA | 200501286 B | * | 9/2005 |

* cited by examiner

*Primary Examiner* — Cassandra Davis

(57) ABSTRACT

A Numerical Configuration Apparatus comprises a frame structure means and a numeric display means. The frame structure means may be comprised mainly of a base frame member and a display securing member. Use display securing member is coupled to the base frame member so that it may be moved towards and away from the base frame member in a controlled manner. Use numeric display means has multiple component members which are pivotally mounted to the frame structure means, and secured in place by the display securing member. Each component has at least two sides, with one side having a different feature, such as color, to distinguish between the two sides. Preferably, the non-distinguishing side should have the same feature, such as color, of the display securing member. Some of the component members are mounted in a generally horizontal position upon the frame structure means, while others are mounted in a generally vertical position.

12 Claims, 12 Drawing Sheets

NUMERICAL CONFIGURATION APPARATUS

BACKGROUND OF THE INVENTION

This invention relates to a Numerical Configuration Apparatus composed of a frame structure means and a numeric display means. The frame structure means has a base frame member and a display securing member. The numeric display means has multiple component members which are pivotally mounted to the base frame member, and secured in place by the display securing member. Each component of the numeric display means has at least two displayable sides, each side having a different feature, such as color, to distinguish between the sides. The component members are arranged on said base frame member in such a manner that pivoting the component members, so that the distinguishing features of the required component members are seen, creates a numeric value.

SUMMARY AND OBJECTS OF THE INVENTION

It is the object of this invention to provide a Numerical Configuration Apparatus which may provide the user an efficient and inexpensive means for creating, displaying, and changing numeric values for viewing. The main purpose of this application is to demonstrate an apparatus which performs the stated function, and to demonstrate the many options and configurations this apparatus may take on.

Briefly stated, the apparatus that forms the basis of the present invention comprises a frame structure means and a numeric display means. The frame structure means may be comprised mainly of a base frame member and a display securing member. The display securing member is coupled to the base frame member so that it may be moved towards and away from the base frame member in a controlled manner. The numeric display means has multiple component members which are pivotally mounted to the frame structure means, and secured in place by the display securing member. Each component has at least two sides, with one side having a different feature, such as color, to distinguish between the two sides. Preferably, the non-distinguishing side should have the same feature, such as color, of the display securing member. Some of the component members are mounted in a generally horizontal position upon the frame structure means, while others are mounted in a generally vertical position. The component members are arranged on said base frame member in such a manner such that pivoting the component members, so that the distinguishing features of the required component members are seen, creates a numeric value.

In order to operate the apparatus, the user will push the display securing member towards the base frame member to unsecure the multiple component members. Once unsecured, the component members are free to rotate. The user then pivots or rotates the component members until the desired numeric value is being display by the distinguishable side of the component member. One the desired numeric value is displayed, the display securing member may be release, and the component members may be re-secured in place so that they may not pivot or rotate.

The frame structure means may also have a resistance element which provides resistance when the display securing member is pushed towards the base frame member. It also will provide a force away from the base frame member when the display securing member is released by the user.

The display securing member will push against the component member, thus securing them in place when the desired numeric value is being displayed. The display securing member keeps any of the component members from accidently pivoting or rotating, preserving the numeric value being displayed.

Electronic numeric displays are very costly, and are expensive to operate and maintain. With manual numeric displays, a series of numbers have to be kept and stored, and changing the sign involves retrieving the new number(s) from a storage place, removing the old number(s), and placing the new number(s) on the display sign. The old number(s) have to then be place back in storage. With this apparatus, there are no numbers which have to be stored, retrieved, changed out, and then restored. This saves the user a lot of both time and money.

The Numerical Configuration Apparatus may be used in any number of applications. These include but are not limited to such items as scoreboards, price signs, and basic numeric display signs. It may also be used as a teaching tool to teach young kids about numbers and mathematical operations.

DETAILED DESCRIPTION OF THE PREFERRED EMBODIMENT

Before explaining in detail the present invention, it is to be understood that the invention is not limited in its application to the details of construction or arrangement of parts illustrated in the accompanying drawings, since the invention is capable of other embodiments and of being practiced or carried out in various ways. Also, it is to be understood that the phraseology and terminology employed herein is for the purpose of description, and not limitation.

Figure 1B:
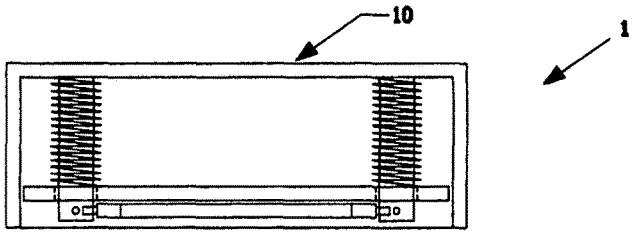
FIG. 1B is a top view of the Numerical Configuration Apparatus.
Figure 1A:
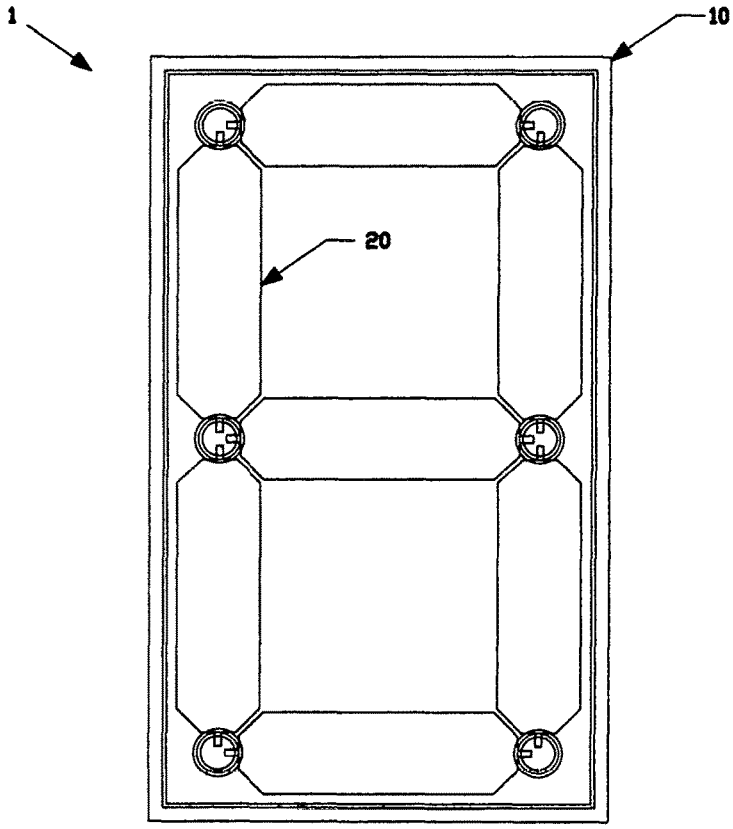
FIG. 1A is a front view of the Numerical Configuration Apparatus.
Figure 1C:
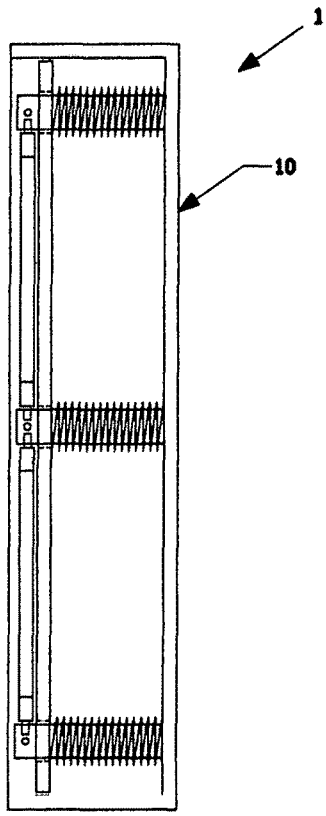
FIG. 1C is a side view of the Numerical Configuration Apparatus.

As best can be seen by references to the drawings, and in particular to FIGS. 1A-1C, the Numerical Configuration Apparatus that forms the basis of the present invention is designated generally by the reference numeral 1, and includes a frame structure means 10 and a numeric display means 20. The numeric display means 20 is pivotally mounted to the frame structure means 20 in such a manner that the apparatus may be configured to display various numeric values. The frame structure means in the figures is shown with top, bottom, right, and left side covers, but these side covers may not be shown in some of the figures that follow. This allows the construction and operation of the apparatus to be more clearly shown. These side covers are preferable, since they help keep debris from getting inside the apparatus.

Figure 2B:
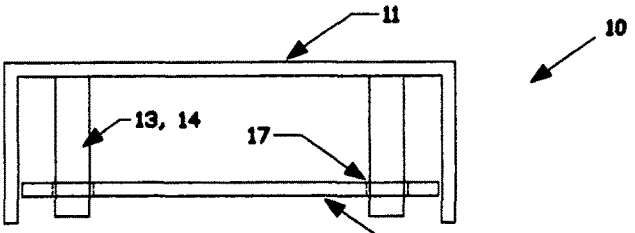
FIG. 2B is a top view of the frame structure means of the Numerical Configuration Apparatus.
Figure 2A:
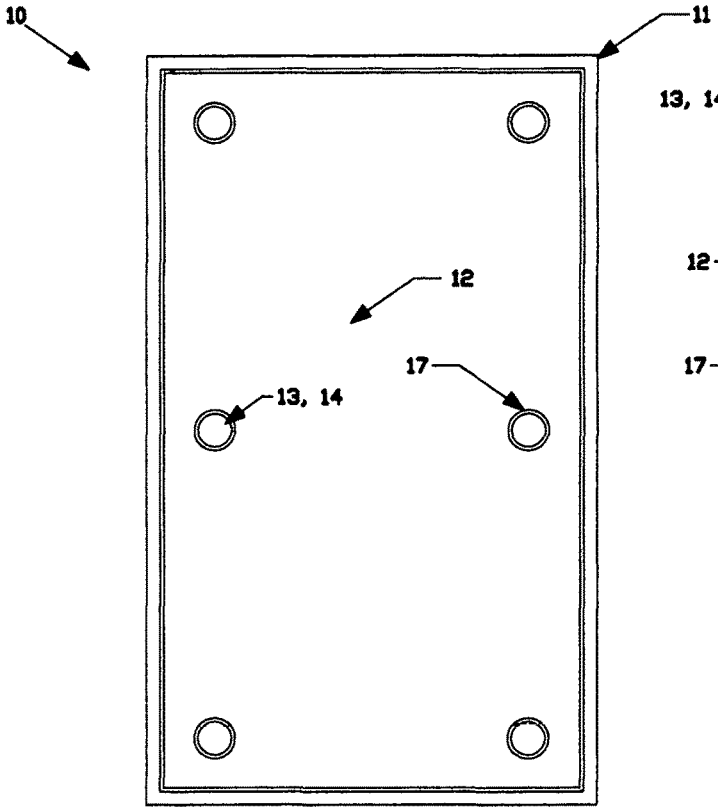
FIG. 2A is a front view of the frame structure means of the Numerical Configuration Apparatus.
Figure 2C:
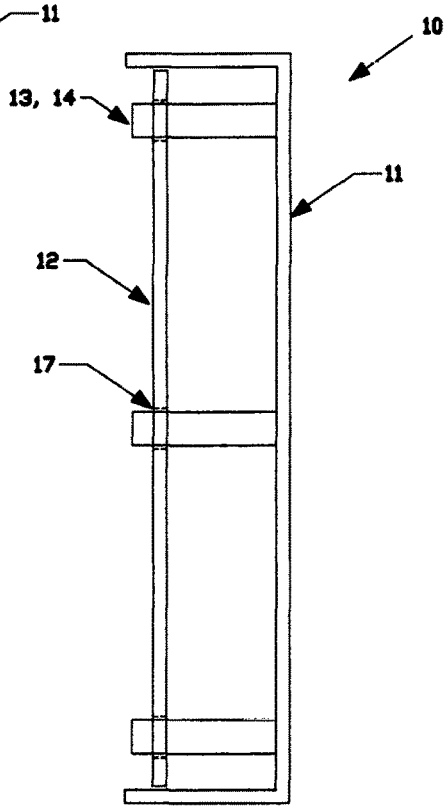
FIG. 2C is a side view of the frame structure means of the Numerical Confirmation Apparatus.

As may be seen in FIGS. 2A-2C, the frame structure means 20 may comprise a base frame member 11, a display securing member 12, base support elements 13, and securing guide elements 14. The display securing member 12 mounts to the base frame member 11 via member openings 17 in such a manner that it may move towards and away from the base frame member 11 in a controlled manner. The numeric display means will pivotally mount to the base frame member 11 while the display securing member 12 will secure the numeric display means and keeps it from pivoting.

Figure 3B:
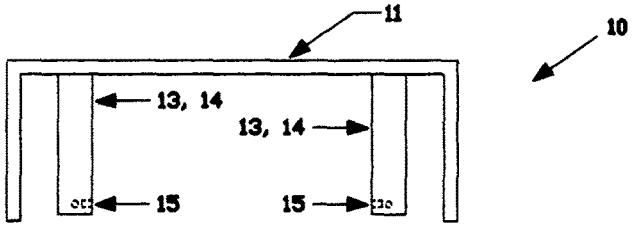
FIG. 3B is a top view of the base frame member, support elements, and guide members of the frame structure means of the Numerical Configuration Apparatus.
Figure 3A:
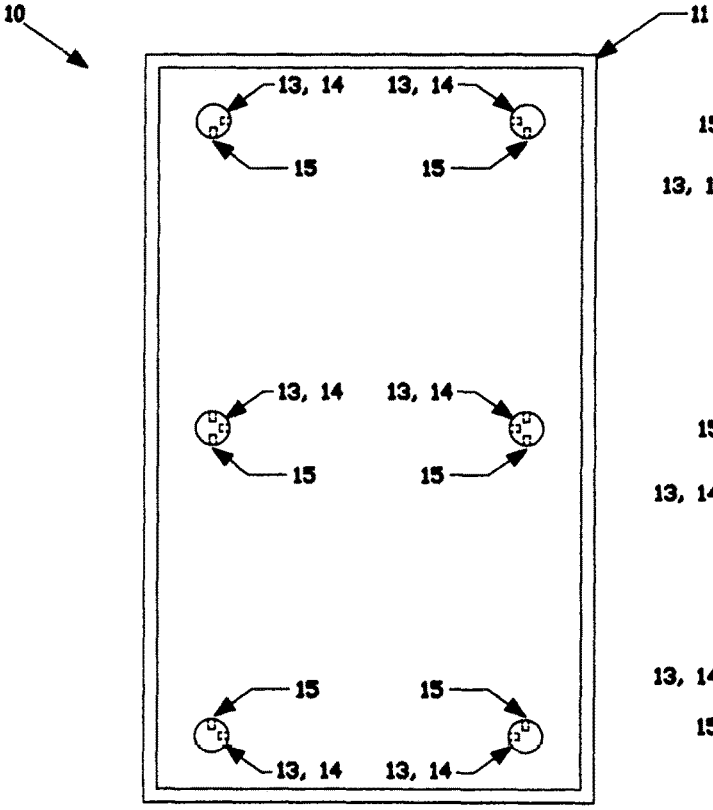
FIG. 3A is a front view of the base frame member, support elements, and guide members of the frame structure means of the Numerical Configuration Apparatus.
Figure 3C:
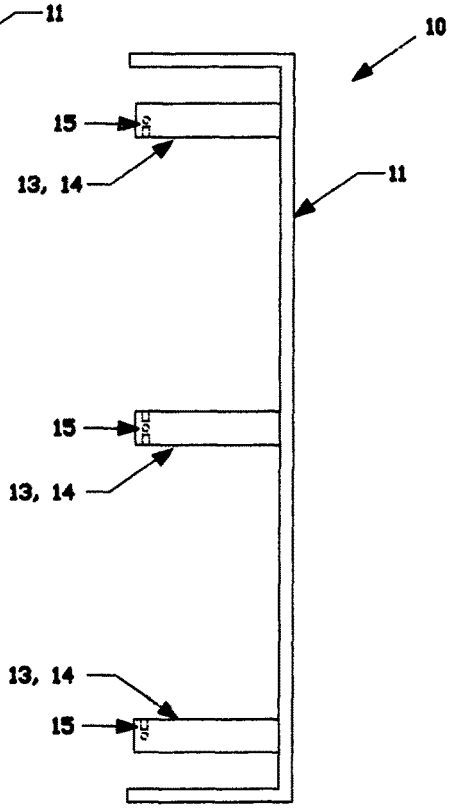
FIG. 3C is a side view of the base frame member, support elements, and guide members of the frame structure means of the Numerical Configuration Apparatus.
Figure 4B:
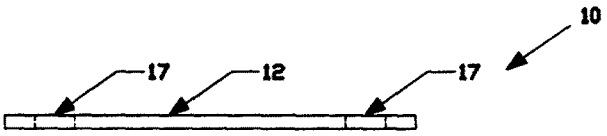
FIG. 4B is a top view of the display securing member of the frame structure means of the Numerical Configuration Apparatus.
Figure 4A:
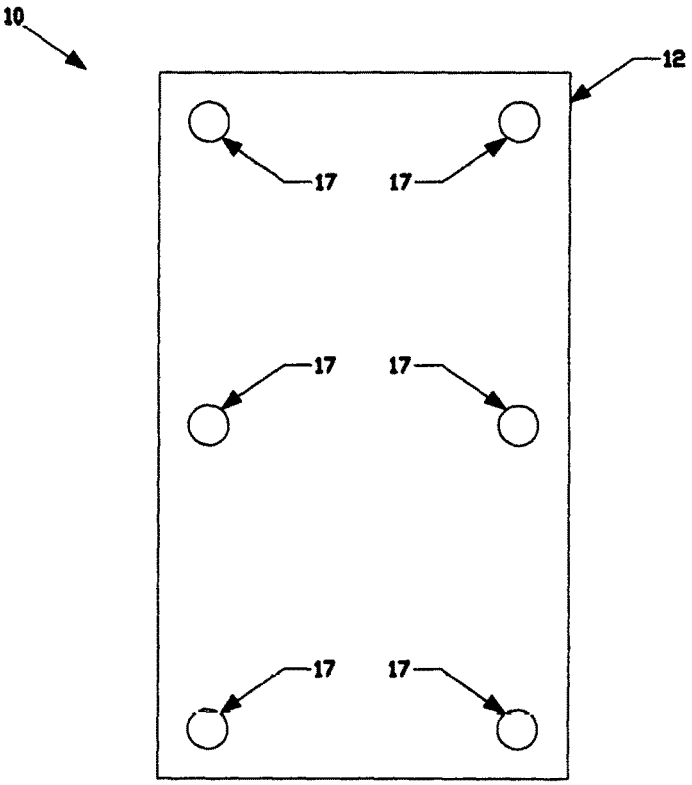
FIG. 4A is a front view of the display securing member of the frame structure means of the Numerical Configuration Apparatus.
Figure 4C:
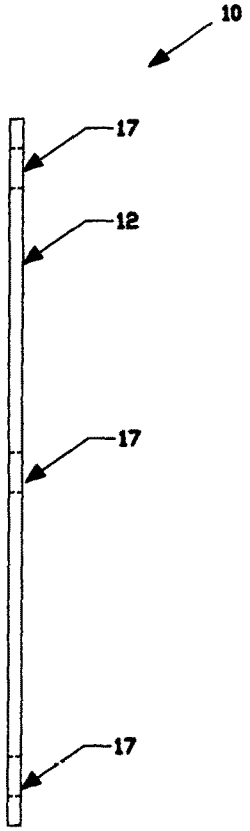
FIG. 4C is a side view of the display securing member of the frame structure means of the Numerical Configuration Apparatus.
Figure 4D:
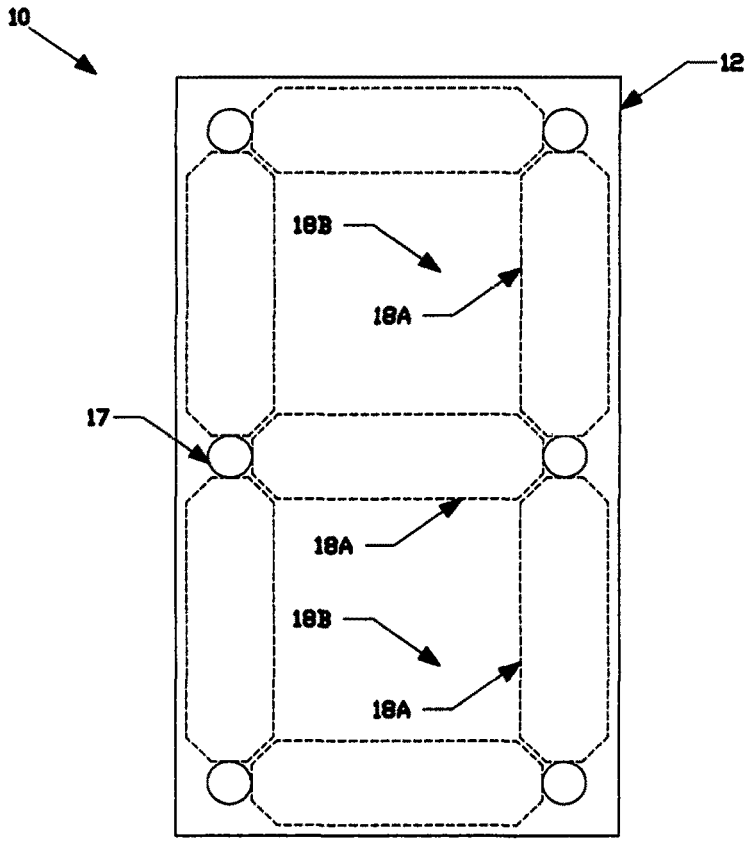
FIG. 4D is a frost view of the display securing member of the frame structure means of the Numerical Configuration Apparatus, showing the engaging areas of the member.

FIGS. 3A-3C show the base frame member 11 of the frame structure means. It is a relatively rigid structure having a generally rectangular shape. The frame structure means also has outwardly extending base support elements 13 rigidly mounted to the base frame member 11, upon which the numeric display means pivotally mounts, and also has outwardly extending securing guide elements 14 which guide the movement of the display securing member 12. Base support elements 13 having element openings 15 into which the numeric display means pivotally mounts. In this case, base support elements 13 and securing guide elements 14 are the same elements, but could also be constructed as separate elements.

FIGS. 4A-4D show the display securing member 12 of the frame structure means. It is a relatively thin, rigid structure having a generally rectangular shape, similar to the base frame member. Display securing member 12 also has member openings 17 which are used to moveably mount it to the base support elements. The display securing member 12 also has secure engaging areas 18A which are used to engage and secure the numeric display means to the frame structure means. These keep the numeric display means from pivoting or rotating. The display securing member 12 also has user engaging areas 18B which are used by the user to push or move the display securing member 12 towards the base frame member.

In the case of a large Numerical Configuration Apparatus it may prove desirable to have the display securing member 12 separated into two separate components, each moving independent of one another towards and away from said base frame member. Each would have its own set of securing guide elements, and would secure different portions of the numeric display means.

Figures 5A, 5B, 5C:
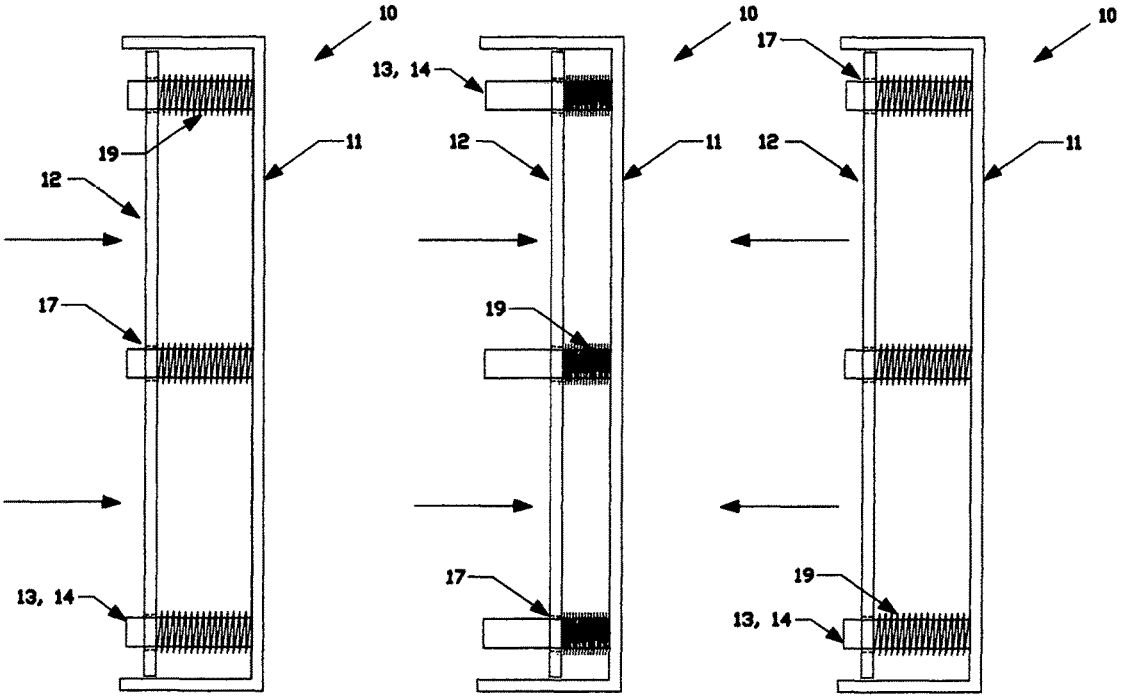
FIG. 5A is a side view of the base frame member and the display securing member of the frame structure means operatively connected to one another.
FIG. 5B is a side view of the base frame member, support elements, guide members, and the display securing member of the frame structure means operatively connected to one another.
FIG. 5C is a side view of the base frame member, support elements, guide members and the display securing member of the frame structure means operatively connected to one another.

FIGS. 5A-5C demonstrate how the base frame member 11, display securing member 12, base support elements 13, and securing guide elements 14 of the frame structure means 10 operatively connect to one another. As mentioned previously, base frame member 11 has outwardly extending base support elements 13 rigidly mounted thereon, upon which the numeric display means mounts, via element openings 15, preferably through a screw system at the bottom for ease of assembly. The base frame member 11 also has outwardly extending securing guide elements 14 rigidly mounted thereon, upon which the display securing member 12 moveably mounts via member openings 17. In this instance, base support elements 13 and securing guide elements 14 are the same elements, but could be constructed as different elements.

As shows, the securing guide elements 14 allow the display securing member 12 to move towards and away from the base frame member 11 in a controller manner. Resistance elements 19 may also be a part of the frame structure means, and provide resistance to the movement of the display securing member 12 towards the base frame member, and provide a force for pushing the display securing member 12 away from said base frame member. These resistance elements 19 may be a number of different types and utilized is several different ways, but the simplest type is the spring version as shown, which may mount over the securing guide elements 14.

Figure 6B:
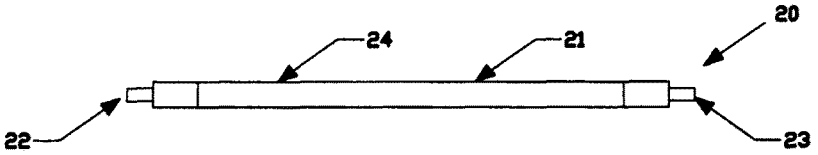
FIG. 6B is a top view of one of the component members of the numeric display means of the Numerical Configuration Apparatus.
Figure 6A:
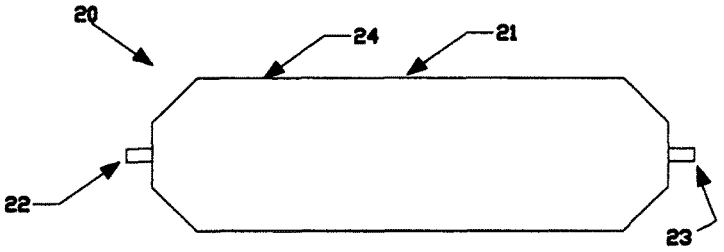
FIG. 6A is a front view of one of the component members of the numeric display means of the Numerical Configuration Apparatus.
Figure 6C:
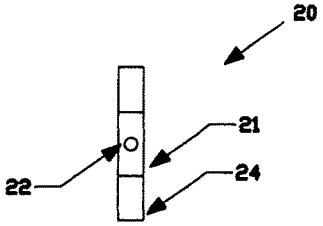
FIG. 6C is a side view of one of the component members of the numeric display means of the Numerical Configuration Apparatus.
Figure 6D:
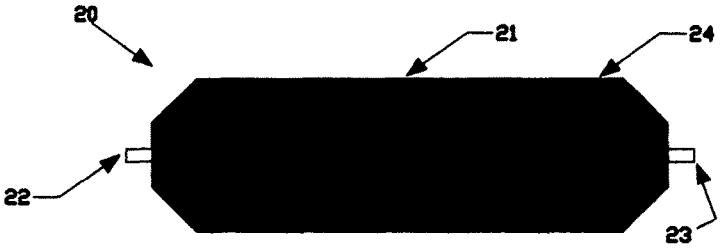
FIG. 6D is a front view of one of the component members of the numeric display means of the Numerical Configuration Apparatus showing a display side that has a color as a distinguishing feature from the opposite side.

As may be seen in FIGS. 6A-6C, the component members 21 of the numeric display means 20 has two ends, a first end 22 and a second end 23. It also has a display structure 24 which located in between the two ends. As shown, the ends 22 and 23 may be round rod-shaped structures which extend outward from the display structure 24. They are sized to rotatably mount within the element openings of the base support elements. The display structure 24 is a relatively elongated structure with at least two displayable sides, one of which has a distinguishing feature, such as color. It is preferred that the non-distinguishing side of component members 21 have the same feature, such as color, as the display securing member, in order for the distinguishing side to better standout when it is used to display a part of the number.

Figure 6E:
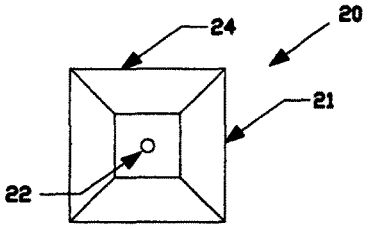
FIG. 6E is a side view of one of the component members of the numeric display means of the Numerical Configuration Apparatus having more than two displayable sides.

It is also possible to construct a component member 21 with more than two displayable sides, as shown in FIG. 6E. In this instance, one side may have the same distinguishing feature, such as color, as the display securing member, while the other sides might have different distinguishing features, such as different colors. This would provide greater flexibility in the apparatus. For example, a four sided component member 21 might have one side with the same color as the display securing member, a second side might be black in color, a third side might be red in color, while a fourth side might be green in color. This allows the apparatus to easily make color changes to the numbers. Other features which might make a side distinguishable include dots, dashes, lines, plaid markings, and hash marks, just to name a few.

Figures 7A, 7B, 7C:
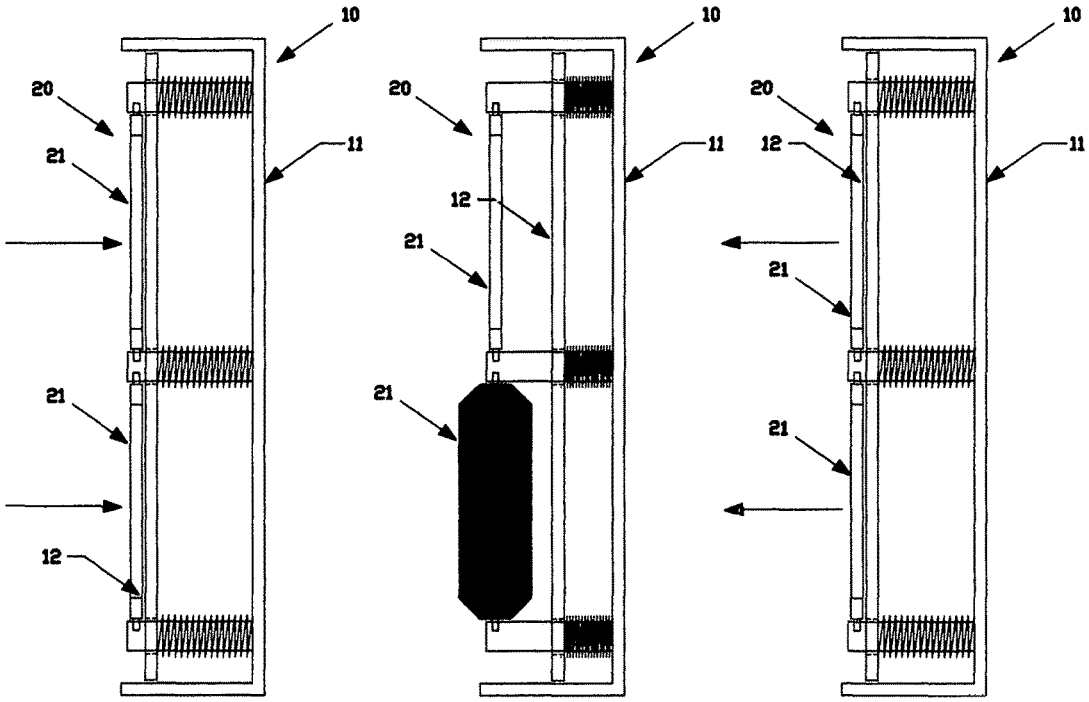
FIG. 7A is a side view demonstrating the operation of the frame structure means and the numeric display means of the Numerical Configuration Apparatus.
FIG. 7B is a side view demonstrating the operation of the frame structure means and the numeric display means of the Numerical Configuration Apparatus.
FIG. 7C is a side view demonstrating the operation of the frame structure means and the numeric display means of the Numerical Configuration Apparatus.

FIGS. 7A-7C demonstrates the operation of the frame structure means 10 and the numeric display means 20 together. As shown, the component members 21 of the numeric display means 20 are pivotally mounted to the base frame member 11 via the element openings of the base support elements. The component members 21 are arranged in a pattern on the base frame member 11 so that numeric values may be created by pivoting and securing the various component members 21 to their desired positions.

As may be further seen from the figures, the user may push the user engaging areas of the display securing member 12 towards the base frame member 11, allowing the component members 21 to pivot or rotate. Once the component members are free to rotate, the user may then pivot or rotate the component members 21 so that either a non-distinguishing side or a distinguishing side is facing away from the display securing member 12. Once the component members 21 have all been pivoted or rotated to their desired positions, the user may then release the user engaging area of the display securing member 12, allowing the display securing member 21 to move away from base frame member 11, and engage component members 21 with its secure engaging areas. The component members 21 are now secured in place.

Figure 8A:
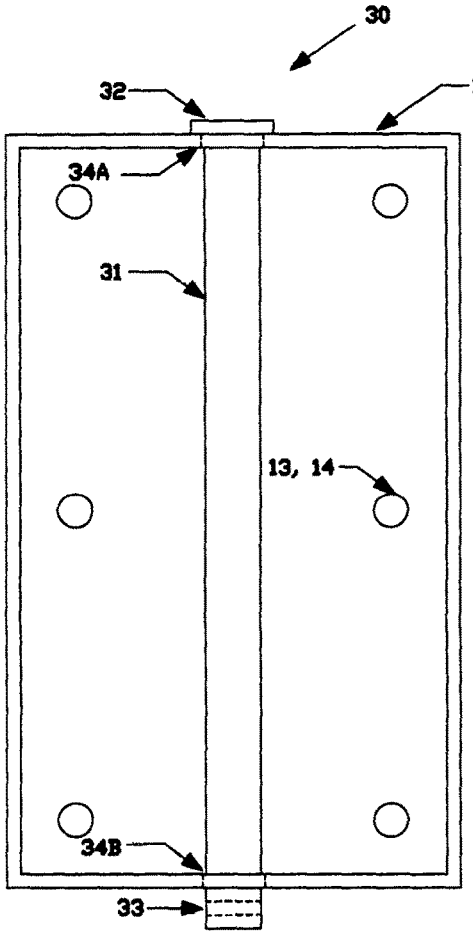
FIG. 8A is a front view of the locking mechanism as past of the Numerical Configuration Apparatus.
Figure 8B:
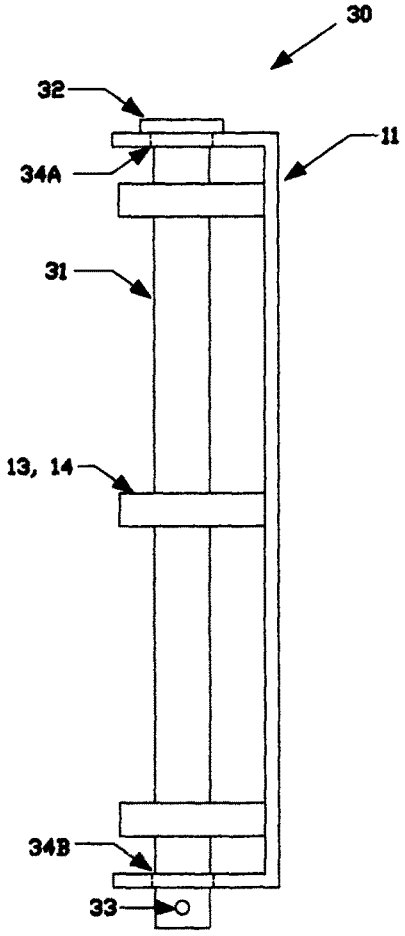
FIG. 8B is a side view of the locking mechanism as part of the Numerical Configuration Apparatus.

FIGS. 8A-8C demonstrate a locking mechanism 30 which may be an optional part of the Numerical Configuration Apparatus. This type of locking mechanism may include a Locking shaft 31, which is an elongated, square, shaft-like structure having two ends. One end of locking shaft 31 has an lock end cap 32, while the second end has shaft opening 33. Locking support openings 34A and 34B may be constructed as part of the top and bottom side covers of the apparatus so that locking shaft 31 is able to slide through. The locking shaft 31 may be pushed first through the upper locking support opening 34A, and then through the lower locking support opening 34B. The lock end cap 32 prohibits the locking shaft 31 from moving completely through the locking supports openings 34A and 34B. The locking shaft 31 may be secured in place by placing a nut and bolt assembly, or even a pad lock, through its shaft opening 33. The locking shaft 31 needs to be of sufficient size so that when it is in place, it prohibits display securing member 12 from moving towards base member 11. When a locking mechanism is used, resistance elements 19 are not really required since the locking shaft 31 will push the display securing member against the component members and keep the component members from pivoting or rotating However, it should prove best to utilize the resistance elements even when the locking mechanism 30 is used.

Figure 9A:
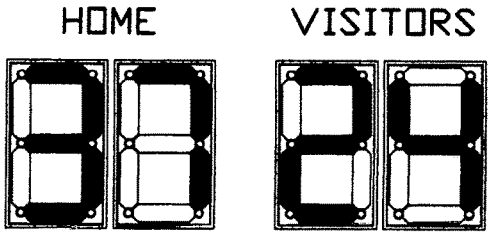
FIG. 9A is a front view of an application of the Numerical Configuration Apparatus.
Figure 9C:
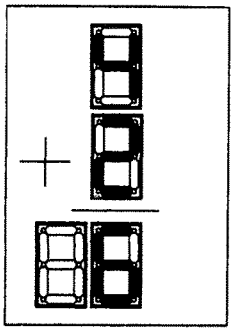
FIG. 9C is a front view of another application of the Numerical Configuration Apparatus.
Figure 9B:
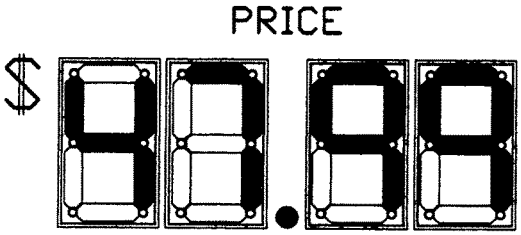
FIG. 9B is a front view of another application of the Numerical Configuration Apparatus.
Figure 10B:
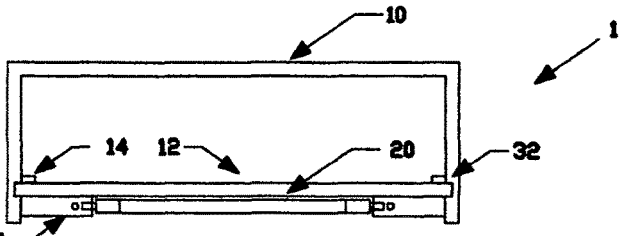
FIG. 10B is a top view of a second version of the Numerical Configuration Apparatus.
Figure 10A:
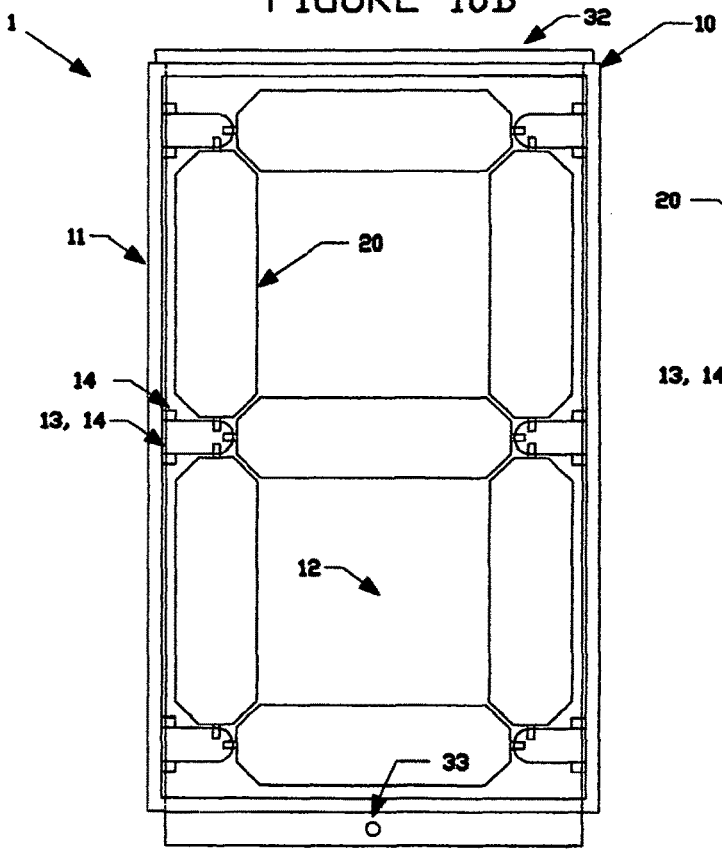
FIG. 10A is a front view of a second version of the Numerical Configuration Apparatus.
Figure 10C:
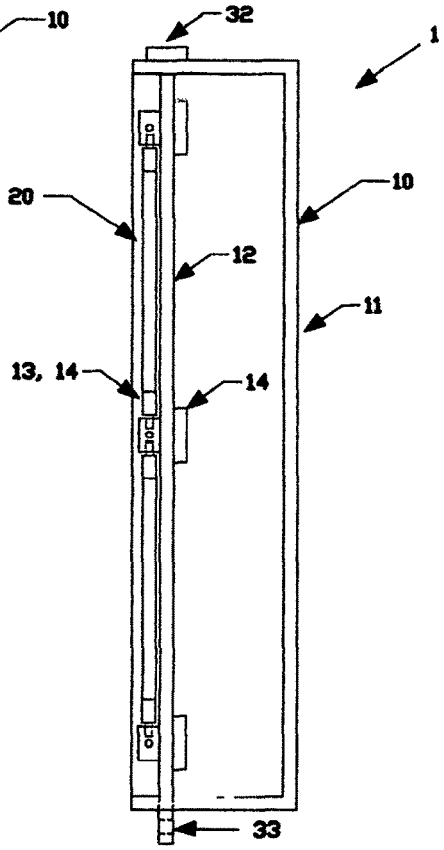
FIG. 10C is a side view of a second version of the Numerical Configuration Apparatus.
Figure 10D:
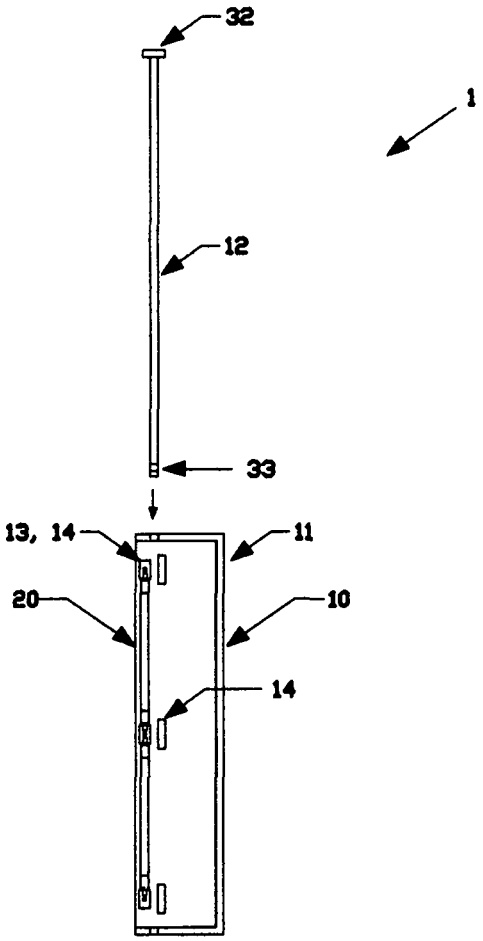
FIG. 10D is a side view of a second version of the Numerical Configuration Apparatus demonstrating the operation of the display securing member and base frame member.

FIGS. 9A-9C demonstrates various applications for the Numerical Configuration Apparatus. These include but are not limited to, a scoreboard, a price sign, and an educational tool. Many other uses exist, and the apparatus should prove to be a very cost effective way to create numeric displays. A locking mechanism would prove useful to lock in a displayed price on a price sign so that no one can change the price. However, a locking mechanism would not prove very useful on a scoreboard, where the numbers are constantly changed.

FIGS. 10A-10D demonstrate a second version of the Numerical Configuration Apparatus 1. In this version, the display securing member 12 is moveable in the upward and downward directions through top and bottom cover slot openings. It does not move towards and away from base support member 11 as in the previous version. The component members 21 are still pivotally mounted to base support members 13, which now mount to the right and left side covers as opposed to being mounted directly to the base support member 11. The securing guide elements 14 are also mounted to the right and left side covers.

As shown, display securing member 12 is supported on its front by base support members 13, which again act as securing guide members 14. The back of the display securing member 12 is suppored by a second set of securing guide elements 14. These securing guide elements 14 guide the display securing member 12 in the upward and downward directions, and are positioned such that the front of display securing member 12 is able to make contact with the back of component members 21, thus securing the component members 21 in place. It acts similar to the locking mechanism mentioned previously, and may have an end cap 32 to keep it from moving completely through the apparatus. It may also have a shaft opening 33 to allow it to be locked into place.

Many variations of the Numerical Configuration Apparatus exist, along with the configurations described above. While it will be apparent that the preferred embodiment of the invention herein disclosed is well calculated to fulfill the objects above stated, it will be appreciated that the invention is susceptible to modification, variation, and change without departing from the proper scope or fair meaning of the subjoined claims.

I claim:

1. A numerical configuration apparatus comprising;

a frame structure means having a base frame member with an upper area, middle area, and lower area, and base support elements;

a numeric display means comprising multiple component members pivotally mounted to said base support elements of said frame structure means, each component member being an elongated structure having a first end, a second end, and a display structure located between said first end and said second end, said first end and said second end of each component member being pivotally mounted to said base support elements of said base frame member of said frame structure means; each of said display structures having at least two displayable sides, a first side and a second side, with said first side having a distinguishing feature from said second side; said multiple component members comprising an upper component member, a middle component member, a lower component member, an upper right component member, an upper left component member, a lower right component member, and a lower left component; said upper component member, middle component member, and said lower component member being pivotally mounted to said base support elements of said frame structure means in a generally horizontal position such that each pivots about a generally horizontal axis; said upper right component member, said upper left component member, said lower right component member, and said lower left component member being mounted to said base support elements of said frame structure means in a generally vertical position such that each pivots about a generally vertical axis; said upper component member pivotally mounted to said upper area of said frame structure means, said middle component member pivotally mounted to said middle area of said frame structure means, said lower component member pivotally mounted to said lower area of said frame structure means, said upper right component member pivotally mounted to the right of said upper and middle component members on said frame structure means, said upper left component member pivotally mounted to the left of said upper and middle component members on said frame structure means, said lower right component member pivotally mounted to the right of said middle and lower component members on said frame structure means, said lower left component member pivotally mounted to the left of said middle and lower component members on said frame structure means, with said ends of said component members being mounted on said frame structure means in close proximity to one another such that a numeric value may be displayed;

a locking mechanism which may be securely positioned behind said display securing member, said locking mechanism being moveable in a plane which is generally parallel to the pivot axes of said multiple component members, such that said display securing member may not be moved towards said base frame member;

whereby said component members of said numeric display means may be arranged in a manner such that when said component members are pivoted so that one of said first side and said second side of each of said component member is facing away from said base frame member, a numeric value is displayed.

2. A numerical configuration apparatus as claimed in claim 1, said base frame member of said frame structure means further comprising outwardly extending securing guide elements upon which a display securing member moveably mounts such that it may be moved away and towards said base frame member of said frame structure means, said display securing member being used to secure said components members in place.

3. A numerical configuration apparatus as claimed in claim 2, further comprising resistance elements mounted upon said securing guide elements for operatively engaging said base frame member and said display securing member, thereby providing a resistance to the movement of said display securing member towards said base frame member, and providing a force for pushing said display securing member away from said base frame member.

4. A numerical configuration apparatus as claimed in claim 3, said component members having more than two displayable sides.

5. A numerical configuration apparatus as claimed in claim 1, said frame structure means further comprising top, bottom, right, and left side covers, said locking mechanism mounted through said top and bottom side covers of said frame structure means and comprising a lock shaft member which may be securely positioned through said top and bottom side covers and behind said display securing member, such that said display securing member may not be moved towards said base frame member, said locking mechanism being used to prohibit the numerical value from being unintentionally changed.

6. A numerical configuration apparatus as claimed in claim 1, said numerical configuration apparatus being part of a set of numerical configuration apparatuses which are used for displaying more than one numeric value.

7. A numerical configuration apparatus comprising;

a frame structure means having a base frame member with an upper area, middle area, and lower area, and base support elements;

a numeric display means comprising multiple component members pivotally mounted to said base support elements of said frame structure means, each component member being an elongated structure having a first end, a second end, and a display structure located between said first end and said second end, said first end and said second end of each component member being pivotally mounted to said base support elements of said base frame member of said flame structure means; each of said display structures having at least two displayable sides, a first side and a second side, with said first side having a distinguishing feature from said second side; said multiple component members comprising an upper component member, a middle component member, a lower component member, an upper right component member, an upper left component member, a lower right component member, and a lower left component; said upper component member, middle component member, and said lower component member being pivotally mounted to said base support elements of said frame structure means in a generally horizontal position such that each pivots about a generally horizontal axis; said upper right component member, said upper left component member, said lower right component member, and said lower left component member being mounted to said base support elements of said frame structure means in a generally vertical position such that each pivots about a generally vertical axis; said upper component member pivotally mounted to said upper area of said frame structure means, said middle component member pivotally mounted to said middle area of said frame structure means, said lower component member pivotally mounted to said lower area of said frame structure means, said upper right component member pivotally mounted to the right of said upper and middle component members on said frame structure means, said upper left component member pivotally mounted to the left of said upper and middle component members on said frame structure means, said lower right component member pivotally mounted to the right of said middle and lower component members on said frame structure means, said lower left component member pivotally mounted to the left of said middle and lower component members on said frame structure means, with said ends of said component members being mounted on said frame structure means in close proximity to one another such that a numeric value may be displayed;

a display securing member mounted upon said base frame member of said frame structure means, said display securing member being movable behind said multiple component members of said numeric display means in a plane which is generally parallel to the pivot axes of said multiple component members, said display securing member also being securable in a stationary position behind said multiple component members;

whereby said component members of said numeric display means may be arranged in a manner such that when said component members are pivoted so that one of said first side and said second side of each of said component member is facing away from said base frame member, a numeric value is displayed.

8. A numerical configuration apparatus as claimed in claim 7, said display securing member being an elongated structure which is capable of being positioned behind every one of said multiple component members, in the general upward and downward directions.

9. A numerical configuration apparatus as claimed in claim 7 said frame structure means further comprising top, bottom, right, and left side covers.

10. A numerical configuration apparatus as claimed in claim 9, said frame structure means further comprising inwardly extending base support elements mounted to said right and left side covers, upon which said multiple component members of said numeric display means are pivotally mounted, and inwardly extending securing guide elements mounted to said right and left side covers, upon which said display securing member is coupled, such that said display securing member may be moved upward and downward, behind said numeric display means, in a controlled manner.

11. A numerical configuration apparatus as claimed in claim 7, said component members having more than two displayable sides.

12. A numerical configuration apparatus as claimed in claim 7, said numerical configuration apparatus being part of a set of numerical configuration apparatuses which are used for displaying more than one numeric value.

* * * * *